US008783519B2

(12) United States Patent
Fontaine et al.

(10) Patent No.: US 8,783,519 B2
(45) Date of Patent: Jul. 22, 2014

(54) DISPENSER FOR DISPENSING COSMETIC PRODUCT ONTO A RECEIVING SURFACE, DISPENSING DEVICE AND ASSOCIATED METHOD

(75) Inventors: Michel Fontaine, Paris (FR); Léandre Lasfargues, Paris (FR); Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 185 days.

(21) Appl. No.: 12/889,146

(22) Filed: Sep. 23, 2010

(65) Prior Publication Data

US 2011/0068127 A1 Mar. 24, 2011

Related U.S. Application Data

(60) Provisional application No. 61/253,282, filed on Oct. 20, 2009.

(30) Foreign Application Priority Data

Sep. 23, 2009 (FR) ..... 09 56563

(51) Int. Cl.
*B67D 7/84* (2010.01)

(52) U.S. Cl.
USPC ..... 222/162; 222/173; 222/184; 222/185.1; 222/494; 222/496

(58) Field of Classification Search
USPC ..... 222/162, 181.1, 185.1, 186, 184, 173, 222/386, 490, 491, 494, 554, 562, 563, 556, 222/166, 495–496; 401/108
See application file for complete search history.

(56) References Cited

U.S. PATENT DOCUMENTS

| | | | | | |
|---|---|---|---|---|---|
| 2,363,474 | A | * | 11/1944 | Schlesinger | 222/179.5 |
| 4,728,006 | A | * | 3/1988 | Drobish et al. | 222/181.3 |
| 4,819,530 | A | * | 4/1989 | Huang | 83/39 |
| 5,024,355 | A | * | 6/1991 | Jouillat et al. | 222/162 |
| 5,297,599 | A | * | 3/1994 | Bucheli | 141/329 |
| 5,307,955 | A | * | 5/1994 | Viegas | 222/107 |
| 5,390,805 | A | * | 2/1995 | Bilani et al. | 215/260 |
| 5,667,107 | A | * | 9/1997 | Lindsey | 222/173 |
| 5,826,755 | A | * | 10/1998 | Burd | 222/309 |
| 5,894,961 | A | * | 4/1999 | Kaufman et al. | 222/212 |
| 5,944,702 | A | * | 8/1999 | Py | 604/298 |
| 5,964,376 | A | * | 10/1999 | Kenosha | 222/1 |
| 6,062,436 | A | * | 5/2000 | Fuchs | 222/212 |

(Continued)

FOREIGN PATENT DOCUMENTS

| | | |
|---|---|---|
| EP | 1 293 440 A1 | 3/2003 |
| GB | 834 873 A | 5/1960 |
| GB | 2 184 493 A | 6/1987 |

*Primary Examiner* — Frederick C Nicholas
(74) *Attorney, Agent, or Firm* — Novak Druce Connolly Bove + Quigg LLP

(57) ABSTRACT

A dispenser includes an end piece defining a product dispensing orifice able to be opened downward opposite a surface located under the end piece. The end piece is able to be maneuvered between a predispensing position, in which the dispensing orifice is closed off and the volume located under the dispensing orifice opposite the receiving surface is entirely free, and a product dispensing position. The dispenser includes a device to protect the dispensing orifice, protruding below the dispensing orifice in the predispensing position and in the dispensing position, in order to hinder contact between a body surface of a user of the dispenser and the dispensing orifice.

16 Claims, 15 Drawing Sheets

(56) References Cited

U.S. PATENT DOCUMENTS

| | | | | |
|---|---|---|---|---|
| 6,378,576 | B2 * | 4/2002 | Thibault et al. | 141/329 |
| 6,488,058 | B1 * | 12/2002 | Dyer et al. | 141/346 |
| 6,705,492 | B2 * | 3/2004 | Lowry | 222/184 |
| 6,716,396 | B1 * | 4/2004 | Anderson et al. | 422/501 |
| 6,923,345 | B1 * | 8/2005 | Laible | 222/185.1 |
| 6,945,432 | B2 * | 9/2005 | Laible | 222/185.1 |
| 6,945,433 | B2 * | 9/2005 | Laible | 222/185.1 |
| 6,957,745 | B2 * | 10/2005 | Thibault et al. | 215/249 |
| 6,981,966 | B2 * | 1/2006 | Green et al. | 604/167.02 |
| 6,991,137 | B2 * | 1/2006 | Schultz | 222/377 |
| RE39,340 | E * | 10/2006 | Adams et al. | 215/253 |
| 7,131,559 | B2 * | 11/2006 | Schultz | 222/377 |
| 8,087,547 | B1 * | 1/2012 | Lindsey | 222/184 |
| 2009/0188950 | A1 * | 7/2009 | Gaus et al. | 222/494 |
| 2009/0212078 | A1 * | 8/2009 | Gaus | 222/490 |
| 2010/0193516 | A1 * | 8/2010 | LaBean et al. | 220/229 |

* cited by examiner

DISPENSER FOR DISPENSING COSMETIC PRODUCT ONTO A RECEIVING SURFACE, DISPENSING DEVICE AND ASSOCIATED METHOD

CROSS-REFERENCE TO RELATED APPLICATIONS

This application claims the benefit of priority under 35 U.S.C. §119(e) of Provisional Patent Application No. 61/253,282 filed Oct. 20, 2009, and claims the benefit of priority under 35 U.S.C. §119 from French Application No. 0956563 filed Sep. 23, 2009, the entire contents of each of which are herein incorporated by reference.

FIELD OF THE INVENTION

The present invention relates to a dispenser for dispensing cosmetic product onto a receiving surface, of the type comprising:

an end piece defining a product dispensing orifice able to be opened opposite a receiving surface located under the end piece, means for protecting the dispensing orifice so as to hinder contact between a body surface of a user of the dispenser and the dispensing orifice, the protective means protruding downward beyond the end piece and delimiting an opening, for the passage of the cosmetic product.

BACKGROUND OF THE INVENTION

Discussion of Background

The term "cosmetic product" is understood in particular within the meaning of the present invention to mean a product as defined in Council Directive 95/35/EEC of Jun. 14, 1993.

The cosmetic product is advantageously in a fluid form. It is, for example, in the form of a liquid, a cream or optionally a powder.

The cosmetic product is intended to be applied to a body surface formed for example by the skin or the keratin fibers of a human being.

Various cosmetic product dispensing devices, which are provided with a reservoir containing the cosmetic product and a dispenser having a product dispensing end piece, are known from WO 03033398, U.S. Pat. No. 7,543,397, US 2007/095,855, JP 3830691, U.S. Pat. No. 6,834,780, FR 2 690 423, FR 2 839 952 and FR 2 899 136.

The product is dispensed from the reservoir, through a dispensing opening formed in the end piece, as far as a receiving surface placed at a distance from the device.

This receiving surface may directly be a body surface of a user. Alternatively, the receiving surface may be located in a container or on an applicator tool, with a view to applying the cosmetic product indirectly to a body surface of the user.

To improve the hygiene of the device, it may be desirable to limit contamination by microbial sources of the cosmetic product held in the reservoir to a minimum.

Microbial contamination of a cosmetic product held in the reservoir results essentially from the contact which may occur between a body surface of a user of the device and the product present on the device.

In this respect, in certain cases, the user of the device will remove the product with his finger, which comes into direct contact with the dispensing end piece, or else will apply his finger to the end piece to clean it once the product has been dispensed.

In order to eliminate or at least limit the problem of microbial contamination, it is known to formulate the cosmetic product with a preservative which prevents microbial proliferation.

FR 2 650 255 and WO 2008/061041 describe cosmetic product dispensers of the abovementioned type, in which the end piece is provided with a resilient closure valve. This valve thus only opens when the cosmetic product is dispensed and closes immediately after dispensing ends, this being likely to limit the possible contamination of the product held in the reservoir.

While the dispenser described in WO 2008/061041 is being used, the product flows by gravity through the open valve as far as the receiving surface.

GB 834873, GB 2 084 493 and EP 1 293 440 disclose cosmetic product dispensers which do not comprise protective means which prevent contact with the dispensed cosmetic product. Moreover, these dispensers do not comprise a closure member which is able to be maneuvered relative to the end piece between a close position and an open position.

In practice, these dispensers are not entirely satisfactory as regards microbial contamination.

SUMMARY OF THE INVENTION

It is thus an aim of the invention to provide a cosmetic product dispenser which affords adequate dispensing of product, while still limiting the risk of microbial contamination of the formulation held in the dispensing device, in particular when this formulation contains no preservative.

To this end, the subject of the invention is a dispenser of the abovementioned type, wherein the protective means comprise a closure element, able to be maneuvered between a closed configuration closing off the volume located under the end piece opposite the dispensing orifice and an open configuration freeing the volume located under the end piece, the end piece being able to be maneuvered in particular in the open configuration of the closure element between:

a predispensing position, in which the dispensing orifice is closed off; and a product dispensing position, in which the dispensing orifice is open so that product can flow by gravity through the dispensing orifice and onto the receiving surface;

and wherein the passage opening is located opposite and underneath the dispensing orifice in the predispensing position and in the dispensing position.

The subject of the invention is also a dispenser for dispensing cosmetic product onto a body surface, of the type comprising an end piece defining a product dispensing orifice able to be opened opposite a receiving surface located under the end piece, the end piece being able to be maneuvered between:

a predispensing position, in which the dispensing orifice is closed off; and a product dispensing position, in which the dispensing orifice is open so that product can flow by gravity through the dispensing orifice and onto the receiving surface, wherein the dispenser comprises means for protecting the dispensing orifice so as to hinder contact between a body surface of a user of the dispenser and the dispensing orifice, the protective means protruding downward beyond the end piece and delimiting an opening, for the passage of the cosmetic product, the passage opening being located opposite and underneath the dispensing orifice in the predispensing position and in the dispensing position.

The dispenser according to the invention may comprise one or more of the following features, taken in isolation or in any technically possible combination(s):

- the protective means comprise a protective peripheral skirt arranged around the end piece, the peripheral skirt delimiting the passage opening;
- the minimum distance between the dispensing orifice and the passage opening in the dispensing position is greater than or equal to 0.4 times, advantageously half, the maximum transverse extent of the passage opening;
- the protective means comprise a base holding the end piece and a closure element fitted permanently on the base, able to be maneuvered between a closed configuration closing off the volume located under the end piece opposite the dispensing orifice and an open passage configuration of the end piece;
- the passage opening is located underneath and spaced apart from the closure element in the predispensing position and in the dispensing position;
- the end piece is able to move with respect to the protective means between a rest position and the predispensing position, the movement of the end piece between the rest position and the predispensing position causing the closure element to pass from its closed configuration into its open configuration;
- the protective means comprise a member urging the end piece into its rest position, the urging member being in particular in one piece with the closure element;
- the end piece is able to move with respect to the protective means between an initial rest position and the predispensing position, the protective means comprising a frangible seal which can be broken when the end piece is moved for the first time with respect to the protective means between the rest position and the predispensing position;
- the dispenser comprises means for actuating the dispensing of cosmetic product onto the receiving surface, the actuating means being able to be activated outside the protective means in order to move the end piece from its predispensing position into its dispensing position;
- the actuating means can be activated by the user in order successively:
- to move the closure element from its closed position into its open position, and then
- to move the end piece from its predispensing position into its dispensing position;
- the end piece has a region that can be deformed under the effect of activation of the actuating means, the passage of the end piece from its predispensing position into its dispensing position being brought about by the deformable region being deformed;
- the peripheral skirt is solid around its entire periphery;
- the peripheral skirt is perforated around its periphery;
- the peripheral skirt delimits a protective cavity holding the end piece in the predispensing position and in the dispensing position, the minimum height of the protective cavity taken parallel to the axis of the end piece being greater than at least twice the length of the end piece protruding into the protective cavity in the dispensing position;
- the end piece is able to move with respect to the protective means between a rest position and the predispensing position, the protective means protruding downward beyond the end piece in the rest position;
- the protective means can be moved together with the end piece at a spacing from the receiving surface after the product has been dispensed;
- the dispenser is intended to be fitted at a lower end of a container which is elongate along an axis A-A', the axis A-A' of the container being intended to be approximately vertical and the dispenser being intended to be below the container, in normal use of the device, in particular so that product can flow by gravity through the dispensing orifice and onto the receiving surface in the product dispensing position;
- the protective means are configured so that the cosmetic product which is dispensed through the end piece does not come into contact with the protective means when it is dispensed on the surface;
- the transverse cross section of the passage opening is greater than the transverse cross section of the dispensing orifice;
- in the predispensing position, the volume located axially downwards below the dispensing orifice is totally free.

The subject of the invention is also a dispensing device of the type comprising:

- a dispenser as defined hereinabove; and
- a cosmetic product container, the dispenser being fitted at a lower end of the container.

The dispensing device according to the invention may comprise one or more of the following features, taken in isolation or in any technically possible combination(s):

- the container is vertically elongate along a container axis, the dispensing opening opening in the axis of the container; and
- the container contains a cosmetic product which includes no preservative.

The subject of the invention is also a method for dispensing a cosmetic product onto a receiving surface, which comprises the following steps:

- supplying a device as defined hereinabove;
- placing the device opposite and above the receiving surface;
- putting the end piece into its predispensing position, in which the dispensing orifice is closed off and the volume located under the dispensing orifice through the passage opening, opposite the receiving surface, is entirely free, the protective means protruding below the end piece in order to hinder contact between a body surface of the user of the device and the dispensing orifice;
- maneuvering the end piece in order to move it from its predispensing position into its dispensing position; and
- flowing the cosmetic product by gravity from the dispensing orifice, through the protective means and the passage opening, onto the receiving surface.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the following description, given solely by way of example, and with reference to the appended drawings, in which.

DETAILED DESCRIPTION OF THE PREFERRED EMBODIMENTS

A first device 10 for packaging and dispensing a cosmetic product 12 is shown in FIGS. 1 to 6.

Figure 4:
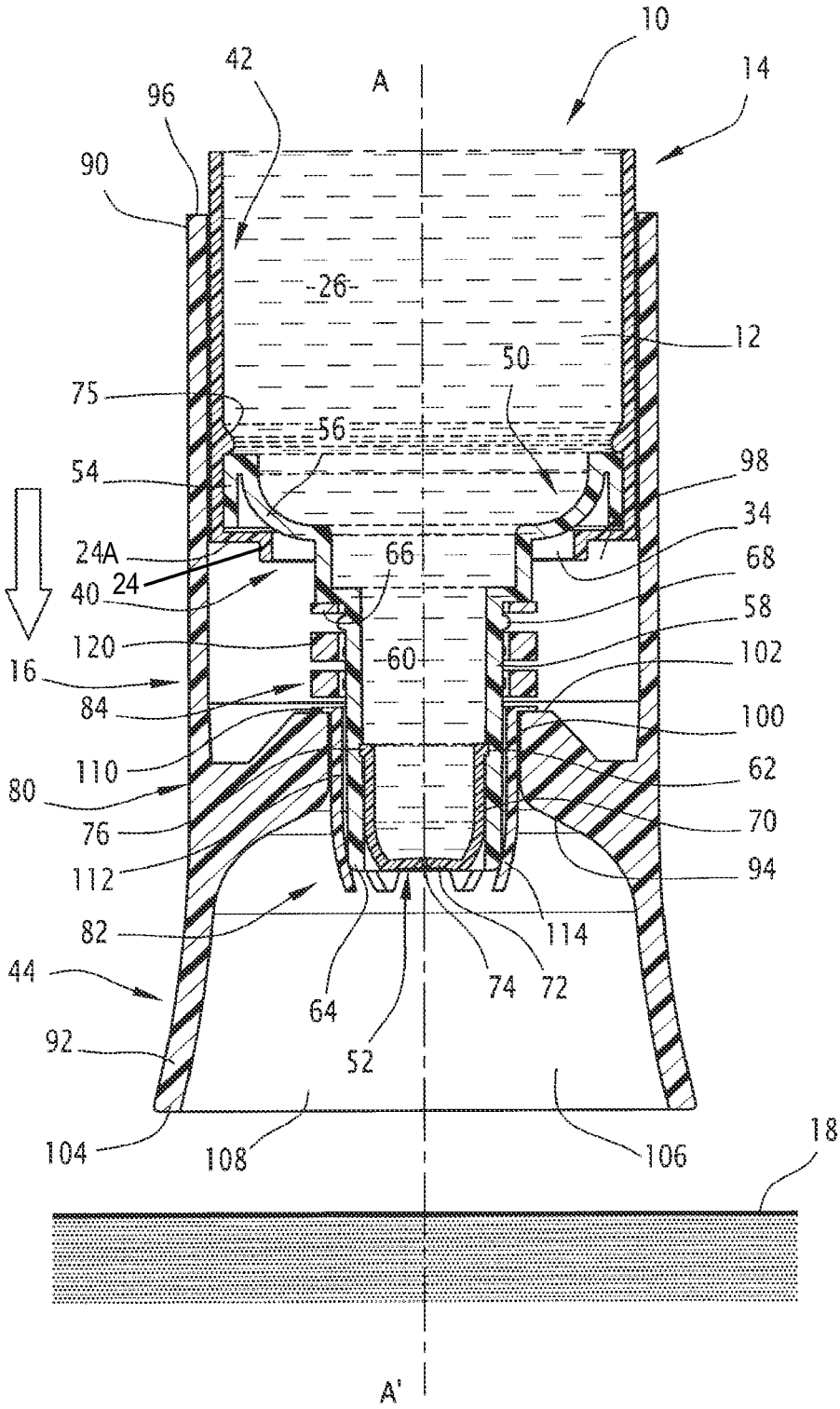
FIG. 4 is a view similar to FIG. 3, the product dispensing end piece occupying a predispensing position.

This device 10 comprises a container 14 for packaging the product 12 and a cosmetic product dispenser 16 according to the invention fitted at the lower end of the container 14 in order to dispense product 12 onto a receiving surface 18, which can be seen in FIG. 4.

The cosmetic product 12 is advantageously in a fluid form. It is formed by a liquid, a cream, or optionally a powder intended to be applied to a body surface of a user, such as the skin or the keratin fibers.

The cosmetic product is advantageously a cream having a viscosity of between 30 poise and 100 poise.

Advantageously, the cosmetic product includes no preservative that prevents bacterial proliferation.

Such preservatives are, for example, alcohols, glycols, parabens, benzoic acids, sodium benzoate, sorbic acid, potassium sorbate, salicylic acid, sodium salicylate, phenoxyethanol, and chlorphenesin.

More generally, these agents are described in the work "International Cosmetic Ingredient Dictionary and Handbook" Seventh Edition, volume 2, pages 1654 and 1655.

The receiving surface 18 is for example delimited in a receptacle such as a dish or a plate, or on an application tool, with a view to applying the cosmetic product to a body surface of the user. Alternatively, the receiving surface 18 is the body surface to which the cosmetic product needs to be applied.

Figure 1:
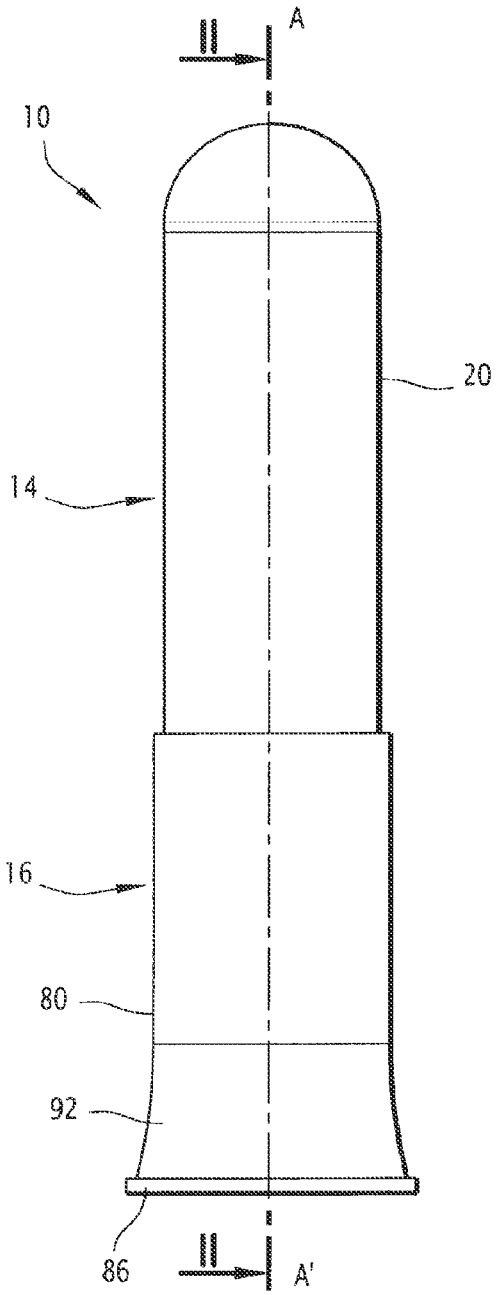
FIG. 1 is a side view of a first dispensing device according to the invention.
Figure 2:
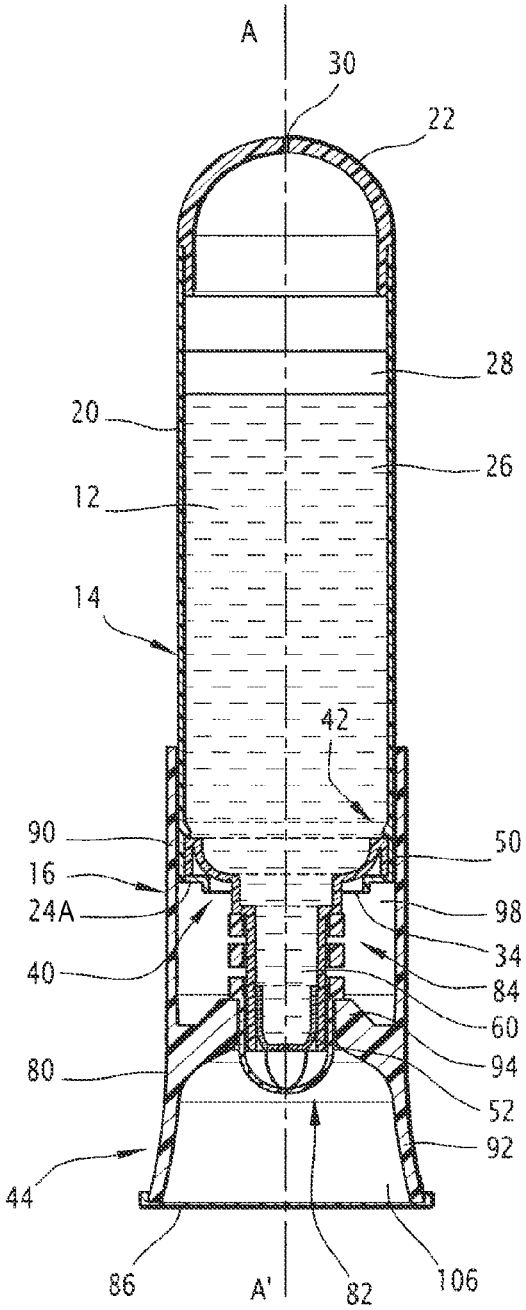
FIG. 2 is a sectional view along the vertical mid-plane II-II in FIG. 1, the product dispensing end piece occupying a rest position.

As illustrated in FIGS. 1 and 2, the container 14 is formed in this example by an elongate bottle of vertical axis A-A'.

The container 14 comprises an approximately cylindrical side wall 20, an upper closure wall 22, secured to the upper end of the side wall 20, and a lower neck, secured to the lower end of the side wall 20 by a shoulder 24A.

The walls 20,22 and the neck 24 delimit an internal volume 26 for packaging the product 12, which holds a follower piston 28.

In this example, the upper wall 22 is attached to the side wall 20. It delimits an opening 30, which opens into the internal volume 26, for equalizing the pressure on either side of the follower piston 28.

In this example, the neck 24 delimits a lower opening 34 for the passage of the dispensing end piece 16, as will be seen further below.

The piston 28 is fitted such that it can slide along the side wall 20 in the volume 26. In a known manner, it is provided with nonreturn means enabling it to move toward the dispenser 16 along the axis A-A' and preventing it from moving away from the dispenser 16 along the axis A-A'.

The dispenser 16 comprises a dispensing end piece 40 secured to the neck 24 of the container, and means 42 for securing the end piece 40 on the container 20. According to the invention, the dispenser 16 also has protective means 44 fitted at the lower end of the container 14 in order to hinder contact between a body surface of the user and the dispensing end piece 40, as will be described in detail further below.

The end piece 40 comprises a hollow basic body 50 and a deformable valve 52 fitted at the lower end of the basic body 50 in order to close off the basic body 50.

Figure 3:
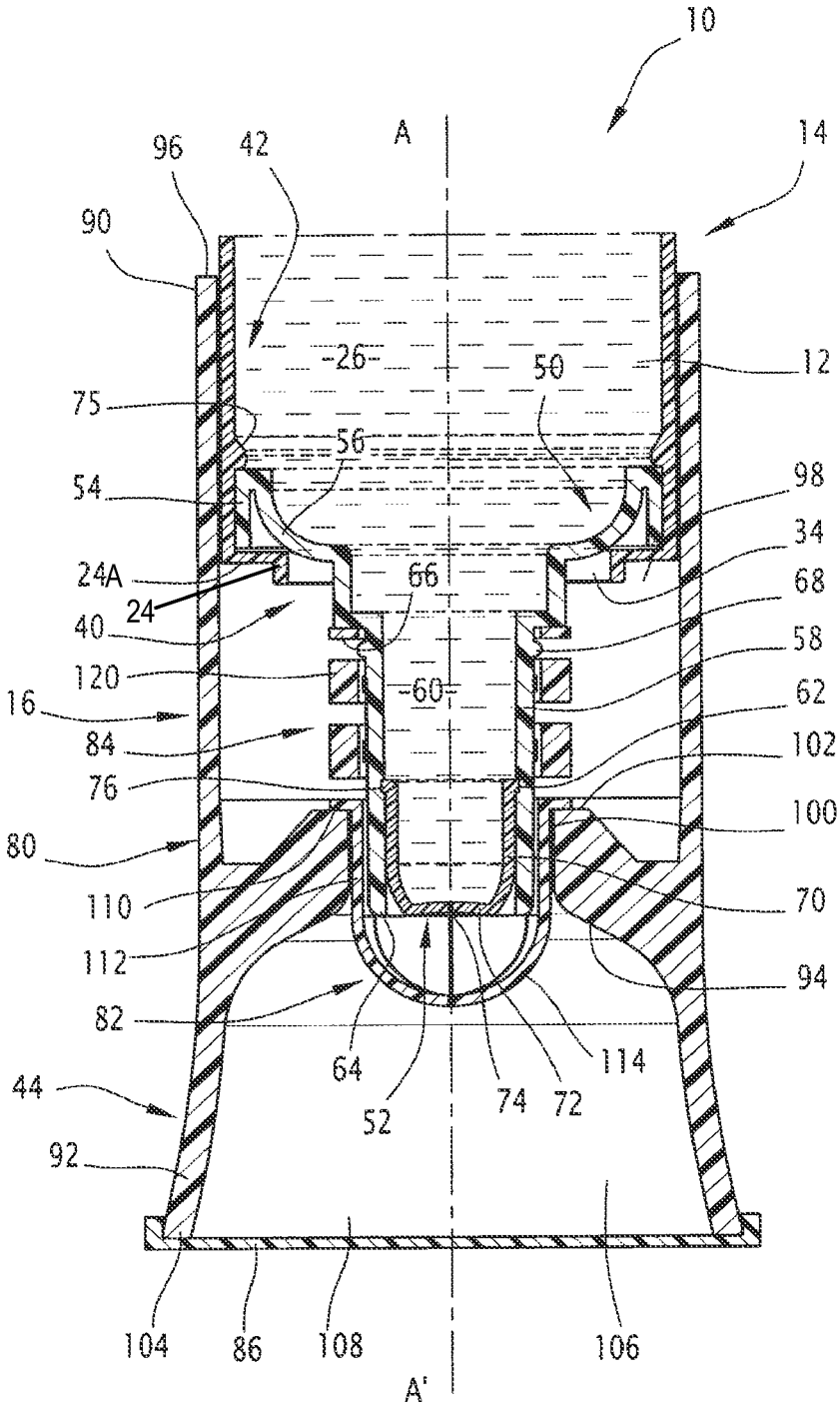
FIG. 3 is a view of a detail of FIG. 2.

As illustrated in FIG. 3, the basic body 50 comprises an external peripheral skirt 54 for connecting to the container 20, a deformable connecting wall 56, and a sleeve 58 holding the valve 52.

The end piece 40 closes off the container 14 downwardly above the neck 24. It protrudes downwardly along the axis A-A' through the lower opening 34 delimited by the neck 24.

The peripheral skirt 54 is held against the side wall 20 of the container 14 above the neck 24.

It is supported axially along the axis A-A' downwardly, by the neck 24, and upwardly, by the retaining means 42.

The connecting wall 56 joins the upper edge of the external peripheral skirt 54 to the upper edge of the sleeve 58. It has an approximately axisymmetrical form about the axis A-A'. Its section in a vertical plane passing through the axis A-A' converges downwardly.

As will be seen further below, the connecting wall 56 can be deformed axially by moving its upper edge toward its lower edge. This movement reduces the internal volume 26 available to contain the cosmetic product and results in cosmetic product 20 being expelled from the end piece 40 through the valve 52.

The sleeve 58 protrudes axially downward out of the lower neck 24 through the lower opening 34. It delimits on the inside a channel 60 for the flow of cosmetic product and an annular groove 62, for blocking the valve, which opens radially into the channel 60.

The channel 60 opens upwardly into the internal volume 26 and downwardly through a lower opening delimited by the lower free edge 64 of the sleeve 58.

The sleeve 58 delimits, close to the connecting wall 56, an annular external shoulder 66 and an external annular ring 68 located under the shoulder 66.

The valve 52 is made of a more flexible material than the basic body 50. It is made, for example, of a deformable elastomer or of silicone.

The valve 52 comprises a peripheral wall 70 held against the internal surface of the sleeve 58 and a lower wall 72 for closing off the channel 60.

The peripheral wall 70 has an upper lip 76 held in the annular groove 62 in order to axially block the valve 52 with respect to the sleeve 58.

The lower wall 72 delimits a dispensing orifice 74 which opens axially downward with respect to the axis A-A' and which opens upwardly into the channel 60.

The valve 52 can be deformed between a configuration closing off the internal volume 26 and the channel 60, in which the dispensing orifice 74 is closed off, and a configuration allowing the passage of the product through the dispensing orifice 74, in which the lower wall 72 has been deformed in order to open the orifice 74.

In the passage configuration, a continuous passage of cosmetic product is established between the internal volume 26 of the container 14, the channel 60 for the flow of product defined by the end piece 40, and through the dispensing orifice 74 as far as the outside of the device 10.

As will be described in detail further below, the end piece 40 is able to move with respect to the protective means 44, together with the container 14, between an upper rest position, an intermediate predispensing position, and a lower product dispensing position.

The means 42 for securing the end piece 40 on the container 14 comprise, in this example, an internal annular bead 75 which protrudes from the side wall 20 of the container 14 toward the axis A-A' in the internal volume 26.

The external peripheral skirt 54 of the body 50 is supported upwardly on the internal bead 75.

The protective means 44 comprise a hollow base 80 holding the end piece 40 and the lower part of the container 14, a closure element 82 protecting the end piece 40 in its rest position, fitted permanently to the base 80, and a resilient member 84 urging the end piece 40 toward its rest position.

In the example shown in FIGS. 1 to 3, the protective means 44 further comprise a protective cap 86 fitted removably under the hollow base 80.

The hollow base 80 comprises an upper wall 90 for guiding the container 14 and the end piece 40, a protective lower peripheral skirt 92 for hindering contact between a body surface of the user and the end piece 40, and an internal annular abutment 94 for guiding the movement of the end piece 40.

In the example shown in the figures, the upper wall 90, the lower skirt 92 and the internal abutment 94 are made in one piece from the same material.

The upper wall 90 has an approximately cylindrical form of axis A-A'. It has an internal section having a form complementary to the external section of the container 14.

The upper wall 90 protrudes upwardly from the external peripheral edge of the internal abutment 94 as far as a free edge 96 located above the neck 24. It delimits on the inside a space 98 for inserting and guiding the lower part of the container 14 and of the end piece 40. The space 98 opens upwardly around the free edge 96 and is partially closed off downwardly by the internal abutment 94.

The container 14 is held such that it can move in a sliding manner along the axis A-A' in the internal space 98, being guided by the engagement of the upper wall 90 of the hollow base 80 with the side wall 20.

The internal abutment 94 protrudes radially toward the axis A-A' between the upper wall 90 and the skirt 92. It delimits a central opening 100 having a form which is approximately complementary to that of the closure element 82.

The radial extent of the central opening 100 about the axis A-A' is less than the radial extent of the space 98. The central opening 100 opens upwardly into the space 98.

The abutment 94 further delimits, around the central opening 100, an upper abutment surface 102 of the closure element 82 and of the urging member 84, as will be described further below. The upper surface 102 extends approximately in a transverse plane with respect to the axis A-A'.

The protective skirt 92 protrudes downwardly under the abutment 94, around and spaced transversely apart from the end piece 40, as far as a lower free edge 104 extending transversely with respect to the axis A-A'.

In this example, the protective skirt 92 is solid around its entire periphery. In a variant, the skirt 92 is partially perforated. It then comprises openings that can extend as far as the free edge 104.

In all cases, the skirt 92 delimits on the inside a cavity 106 for protecting the end piece 40 in which the lower end of the end piece 40 and the dispensing orifice 74 are located in the predispensing position and in the dispensing position.

The protective cavity 106 opens upwardly into the central opening 100. It has a radial extent about the axis A-A' greater than that of the central opening 100.

The protective cavity 106 opens downwardly through a lower opening 108, for the passage of product, extending opposite the orifice 74 in the product dispensing position.

The cross section of the passage opening 108 is greater than, advantageously at least twice as large as, the cross section of the end piece 40 and the cross section of the dispensing orifice 74.

Figure 5:
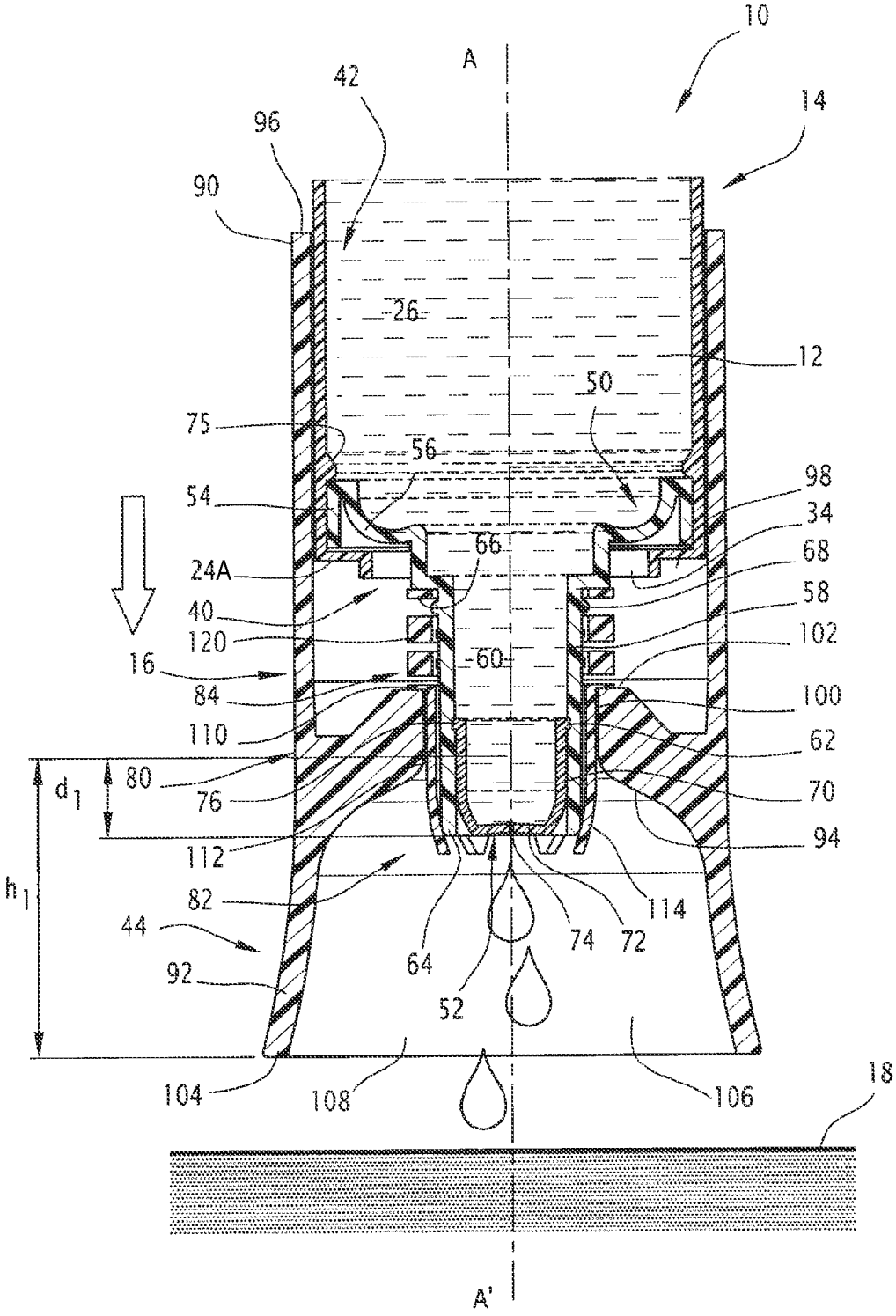
FIG. 5 is a view similar to FIG. 3, the product dispensing end piece occupying a dispensing position.
Figure 6:
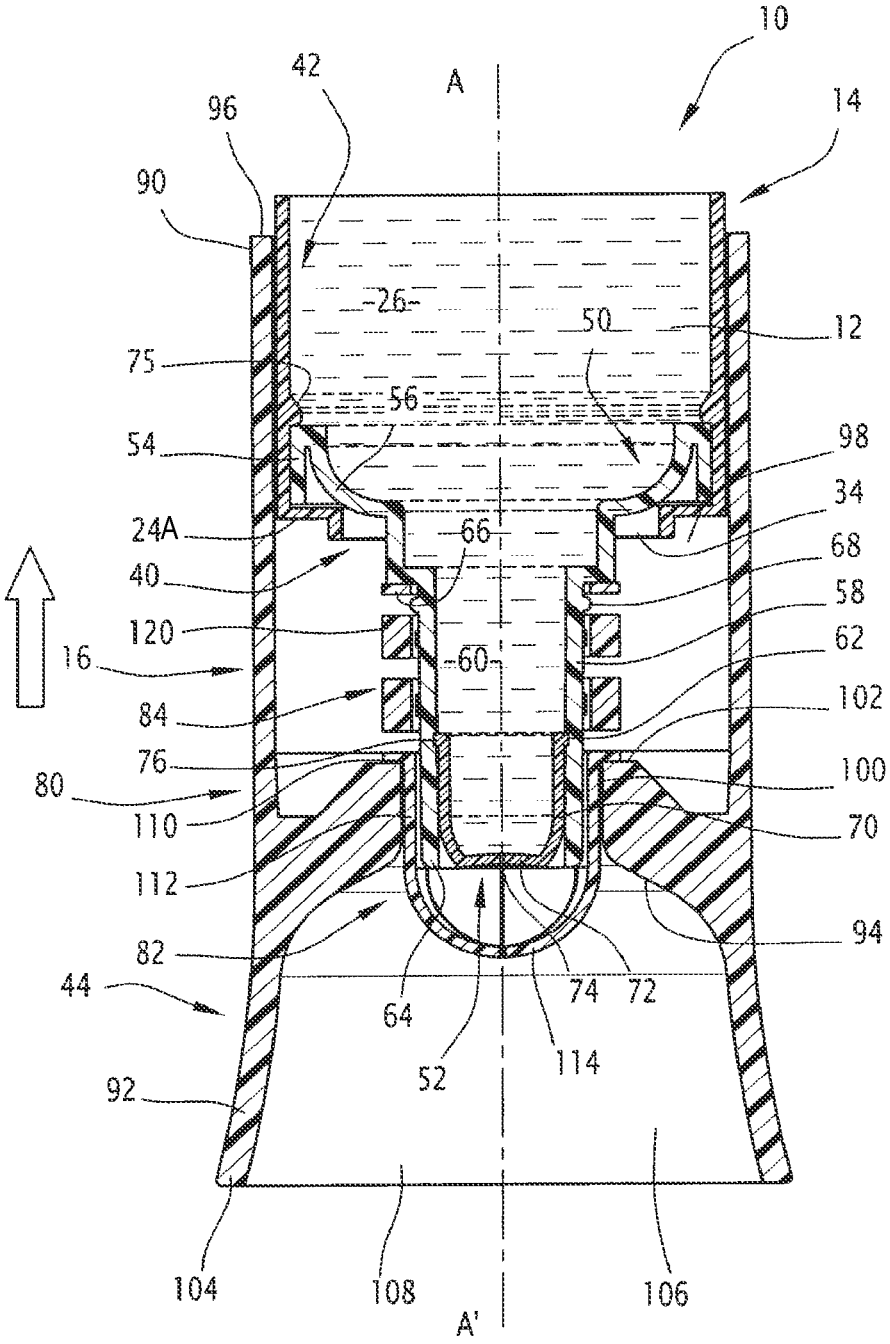
FIG. 6 is a view similar to FIG. 3 after dispensing of the cosmetic product.

The height h1 of the skirt 92 and of the protective cavity 106 parallel to the axis A-A' between the lower free edge 104 and the outlet of the central opening 100 is greater than at least twice the distance d1 between the lower end of the central opening 100 of the dispensing orifice 74 in the dispensing position shown in FIG. 5.

The height of the skirt 92 is moreover greater than at least twice the maximum travel of the end piece 40 along the axis A-A' between its rest position shown in FIG. 3 and its product dispensing position shown in FIG. 5.

Similarly, in the dispensing position and in the predispensing position, the distance between the dispensing orifice 74 and the dispensing opening 108 defined by the skirt 92 is greater than twice the transverse extent of the dispensing orifice 74. This distance is also greater than the length of the end piece 40, which protrudes into the cavity 106, along the axis A-A' of the end piece 40.

The distance between the dispensing orifice 74 and the dispensing opening 108 in the dispensing position is advantageously greater than or equal to 0.4 times, advantageously half, the maximum transverse extent of the passage opening 108. For example, for an opening diameter equal to 50 mm, the distance is equal to 25 mm.

Thus, in normal use of the device 10, keeping the axis A-A' approximately vertical and the dispenser 16 below the container 14, the skirt 92 is able to hinder accidental or deliberate contact between a body surface of the user and the dispensing orifice 74.

Furthermore, the skirt 92 hinders accidental contact between the receiving surface 18, which may have previously been contaminated, and the end piece 40.

In this example, the closure element 82 and the urging member 84 are made in one piece from the same material. Alternatively, these elements are formed by two separate parts.

The closure element 82 comprises an upper retaining flange 110, a tubular base 112 held in the central opening 100 and a plurality of petals 114 which can be deformed between a closed configuration closing off the volume located under the end piece 40 and an open configuration freeing the volume located under the end piece 40.

The retaining flange 110 is held against the upper surface 102 of the abutment 94 in the space 98. It prevents the overall downward axial movement of the closure element 82 during the downward movement of the end piece 40.

The base wall 112 has an external surface having a section approximately equal to that of the internal opening 100 and an internal section having a form approximately complementary to that of the sleeve 58 opposite the valve 52, so as to obtain a sliding assembly.

The petals 114 protrude downwardly into the protective cavity 106.

The petals 114 can be deformed between the closed configuration of the closure element 82 preventing access to the end piece 40 from the outside through the protective cavity 106 and the open passage configuration of the end piece 40.

In the closed configuration shown in FIG. 2, the petals 114 each have the form of a portion of dome converging toward the axis A-A'.

Each side edge of a petal 114 is thus in contact with or close to a side edge of an adjacent petal 114. The free ends of the petals 114 are in contact with or close to one another, such that the closure element 82 has approximately the form of an inverted dome.

In the open configuration, the petals 114 have been spaced apart from the axis A-A' in order to be inscribed approximately in a cylinder of axis A-A'.

The free ends of the petals 114 are spaced apart from one another away from the axis A-A'. The petals 114 delimit between one another a central flow passage in the end piece 40 through the closure element which opens upward and downward.

In the example shown in FIGS. 1 to 6, the urging member 84 is formed by a helical spring 120 interposed between the end piece 40 and the abutment 94 in the flow space 98.

The spring 120 has an upper end supported axially between the shoulder 66 and the ring 68, in order that it can be moved axially with the end piece 40. It has a lower end supported on the flange 102 in order to remain more or less immobile axially on the abutment 94 while the end piece 40 moves axially.

The spring 120 is able to be compressed axially in order to generate a force urging the end piece 40 into its upper rest position.

The cap 86 is fitted removably around the free edge 104 of the protective skirt 92 in order to temporarily close off the cavity 106. It can be moved manually away from the protective skirt 92 by the user of the device in order to free the lower opening 108.

The manner in which the first device 10 according to the invention works will now be described.

Initially, the internal volume 26 contains cosmetic product confined upwardly by the follower piston 28, laterally by the side wall 20 and downwardly by the valve 52 of the closure end piece 40.

The end piece 40 is kept in its upper rest position (shown in FIGS. 2 and 3) by the resilient urging member 84.

In this position, the height of the container 14 inserted into the space 98 is at a minimum. The connecting wall 56 is not significantly deformed and is located relatively spaced apart from the abutment 94.

The closure element 82 occupies its closed configuration in the form of a dome. The dispensing orifice 74 is located above the closure element 82 approximately opposite the abutment 94.

The valve 52 is at rest and the dispensing orifice 74 is closed off to prevent the cosmetic product 20 passing downward.

The removable cap 86 is fitted around the free edge 104 of the skirt 92 in order still to limit access to the cavity 106.

The distance between the lower wall 72 of the valve 52 and the lower free edge 104 of the skirt 92 is at a maximum.

Next, the user removes the cap 86 in order to free access to the cavity 106 and the volume located axially under the closure element 82. The user then presses on the container 14 by exerting pressure downward along the axis A-A'. This causes the relative movement of the container 14 and the end piece 40 along the axis A-A' with respect to the protective means 44 in order to move the end piece 40 from its rest position into its predispensing position, which is shown in FIG. 4.

During this movement, the container 14 slides downward along the axis A-A' in the upper guide wall 90. The end piece 40 moves downward, compressing the urging means 84 between the external shoulder 66 and the flange 110.

The sleeve 58 then comes into contact with the petals 114 and spaces them away from the axis A-A'. The closure element 82 thus passes into its open configuration.

The valve 52 is then located at least partially protruding downwardly in the protective cavity 106 while remaining relatively above the free edge 104, in order to limit the risk of contact between a body surface of the user and the end piece 40.

In the predispensing position, the valve 52 remains closed and the dispensing orifice 74 remains closed off.

The volume located axially downwardly below the dispensing orifice 74 is totally free. The skirt 92 is nevertheless interposed between the receiving surface 18 and the orifice 74 in order to hinder contact between this surface 18 and the orifice 74.

Next, as shown in FIG. 5, the user continues to move the container 14 toward the dispenser 16 to further increase the height of the container 14 introduced into the space 98.

The deformation force of the urging member 84 is thus greater than the deformation force of the deformable connecting wall 56. The wall 56 thus deforms axially and its lower edge moves toward its upper edge.

This leads to a reduction in the internal volume 26 available to hold the cosmetic product and as a result to an increase in the pressure in the internal volume 26, leading to the dispensing orifice 74 opening.

The end piece 40 remains housed in the protective cavity 106, approximately at the same distance from the free edge of the skirt 92 as in the predispensing position.

With the dispensing orifice 74 opening, the cosmetic product 20 flows by gravity from the internal volume 26, through the channel 60 and then through the orifice 74. It flows downward in the protective cavity 106 and falls by gravity through the opening 108 onto the receiving surface 18 without being hindered. This ensures that the cosmetic product is not deposited in the cavity 106 and thus limits the risk of the user inserting a finger into the cavity 106 in order to clean it.

It is noted that the protective means 44 are arranged such that the cosmetic product dispensed through the end piece 40 does not come into contact with the protective means 44 when it is dispensed onto the surface 18.

The user then releases the container 14. With no pressure being exerted on the container 14, the connecting wall 56 resumes its initial form and the urging member 84 extends into its rest configuration. The container 14 and the end piece 40, which are connected to one end of the member 84, move back up along the axis A-A' toward the rest position of the end piece 40.

During this movement, the follower piston 28 moves downward under the effect of the reduced pressure created in the internal volume 26.

Moreover, the petals 114 of the closure element 82 flap toward one another into the closed position in order to close off the cavity 106 upwardly and prevent any contact of the surface 18, or of a body surface of the user, with the end piece 40, the dispensing orifice 74 of which is confined between the closure element 82 and the container 14.

Thus, as soon as dispensing has stopped, access to the dispensing orifice 74 is prevented entirely, thereby avoiding the user deliberately or accidentally touching the dispensing orifice 74 and thus contaminating the cosmetic product 20 held in the container 14.

Once the cosmetic product has been received on the surface 18, the user can then apply it to the body surface, in the case where the surface 18 is not a body surface.

In this example, the container 14 is actuated by the user in order to move the end piece 40 in succession from its rest position into its intermediate predispensing position and then into its dispensing position. As such it forms a means for actuating the dispensing of product.

In a variant (not shown), the dispensing device 10 has no closure element 82. The risk of contamination of the dispensing orifice 74 nevertheless remains very limited on account of the presence of the skirt 92, which hinders access to the dispensing orifice 74.

A second device 130 according to the invention is shown in FIGS. 7 to 12.

Unlike the first device 10, the lower neck 24 of the container 14 is attached to the lower end of the side wall 20.

Moreover, the urging members 84 and the closure element 82 are formed in the lower neck 24.

Figure 8:
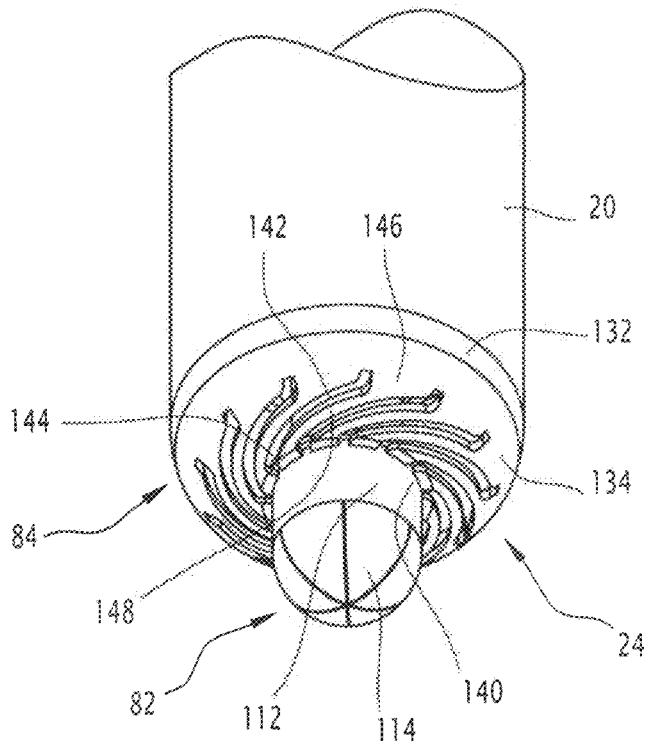
FIG. 8 is a perspective view partially from below of part of the protective means of the device shown in FIG. 7, in a rest position.
Figure 10:
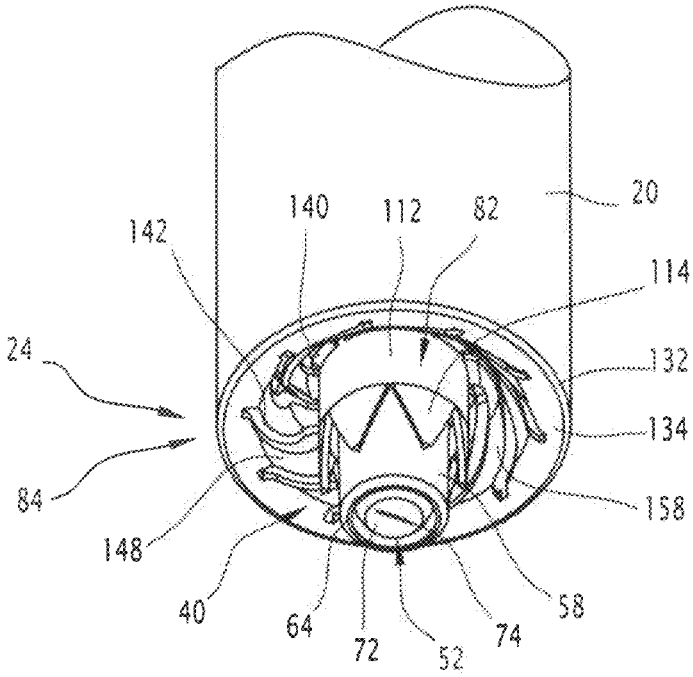
FIG. 10 is a view similar to FIG. 8, in the predispensing position.
Figure 9:
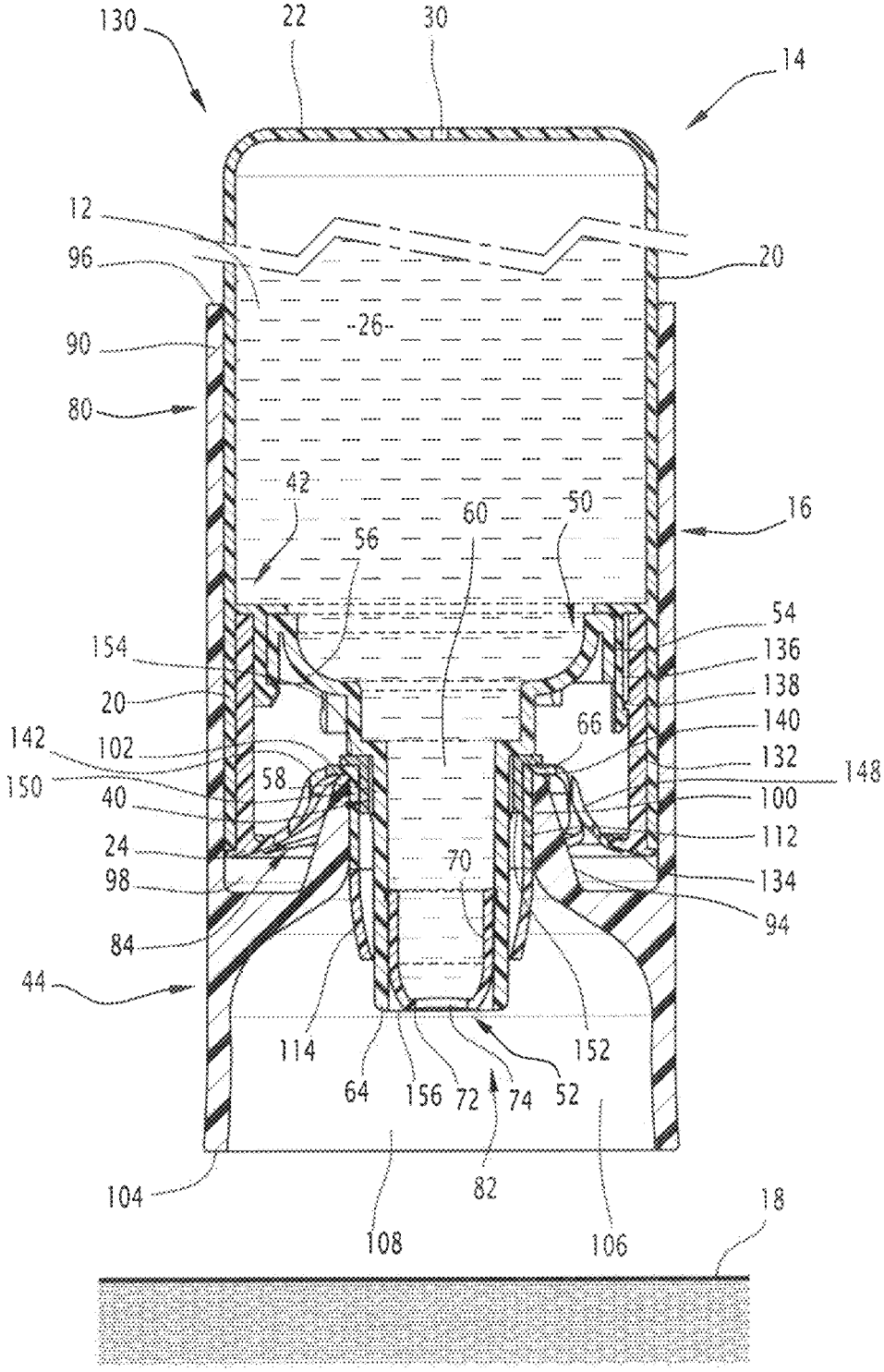
FIG. 9 is a view similar to FIG. 4 of the second device according to the invention.

To this end, as illustrated in FIGS. 8 and 10, the neck 24 comprises an external peripheral wall 132 inserted into the side wall 20 and a lower transverse wall 134 converging radially toward the axis A-A' as far as the closure element 82.

Figure 7:
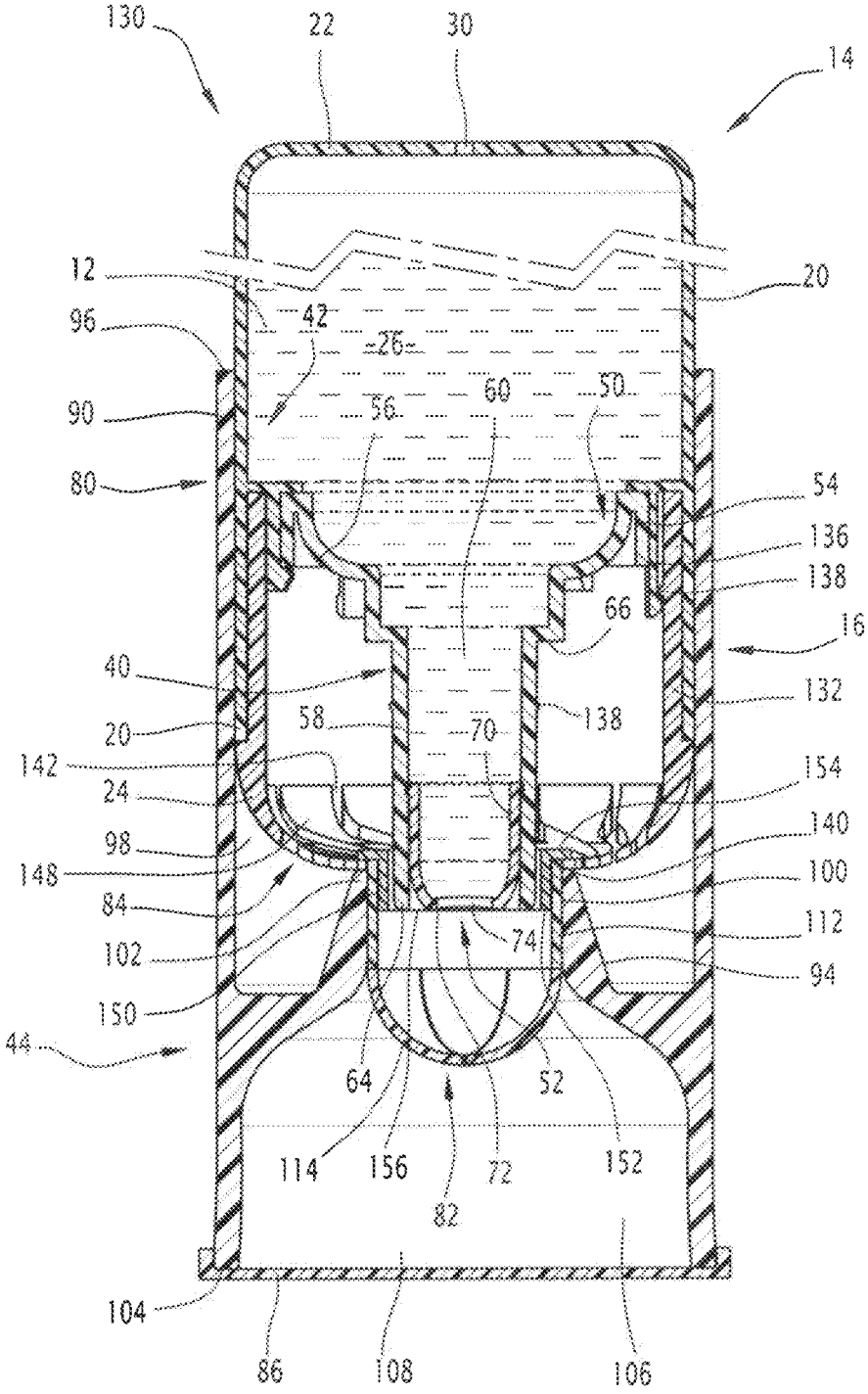
FIG. 7 is a view similar to FIG. 3 of a second dispensing device according to the invention.

As illustrated in FIG. 7, the external wall 132 is retained axially, with respect to the side wall 20, by way of a retaining tab 138 snap-fastened onto a protrusion 136 secured to the external wall 132. The external wall 132 is clamped between the protrusion 136 and the wall 20.

The transverse wall 134 converges toward the bottom as far as an upper edge 140 of the closure element 82.

The transverse wall 134 delimits a plurality of slots 142 in the form of a circular arc around the axis A-A'. Each slot 142 extends between an internal end located on the upper edge 140 of the closure element 82 and an external end located near the periphery of the wall 134.

The slots 142 delimit between one another deformable resilient tongues 148 having an internal end 144 connected to the closure element 82 at the upper edge 140 and an external end 146 which can be moved together with the container 14 with respect to the external end 144.

The neck 24 is arranged pressing against the upper surface 102 of the annular abutment 94. The upper edge 140 of the closure element 82 and the internal ends 146 of the tongues 148 remain secured to the upper surface 102 while the container 14 moves toward the protective means 44.

In a variant shown in FIGS. 7 to 12, the second device 130 also differs from the first device 10 in that a breakable seal 150 is fitted at the lower end of the end piece 40 in its initial rest position, shown in FIG. 7, before the first use of the device 130.

The seal 150 comprises a retaining ring 150 surrounding the sleeve 58. The ring 152 has a flange 154 held against the upper edge 140 of the closure element 82, pressing indirectly on the annular abutment 94.

The seal 150 further comprises a frangible film 156 downwardly closing off the channel 60 around the free edge, under the dispensing orifice 74.

Figure 18:
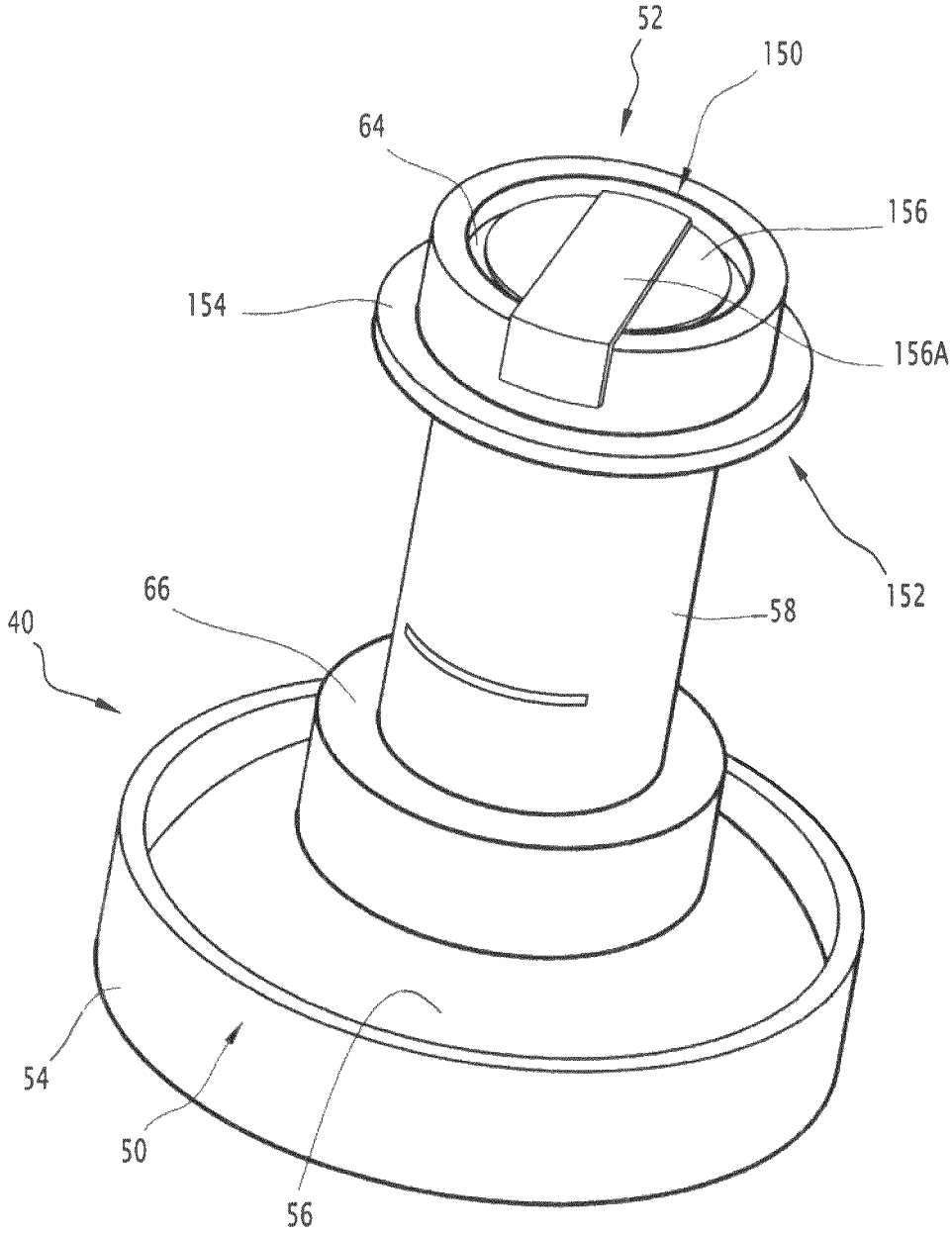
FIG. 18 is a view of a detail of the breakable seal of the second device before its first use.
Figure 19:
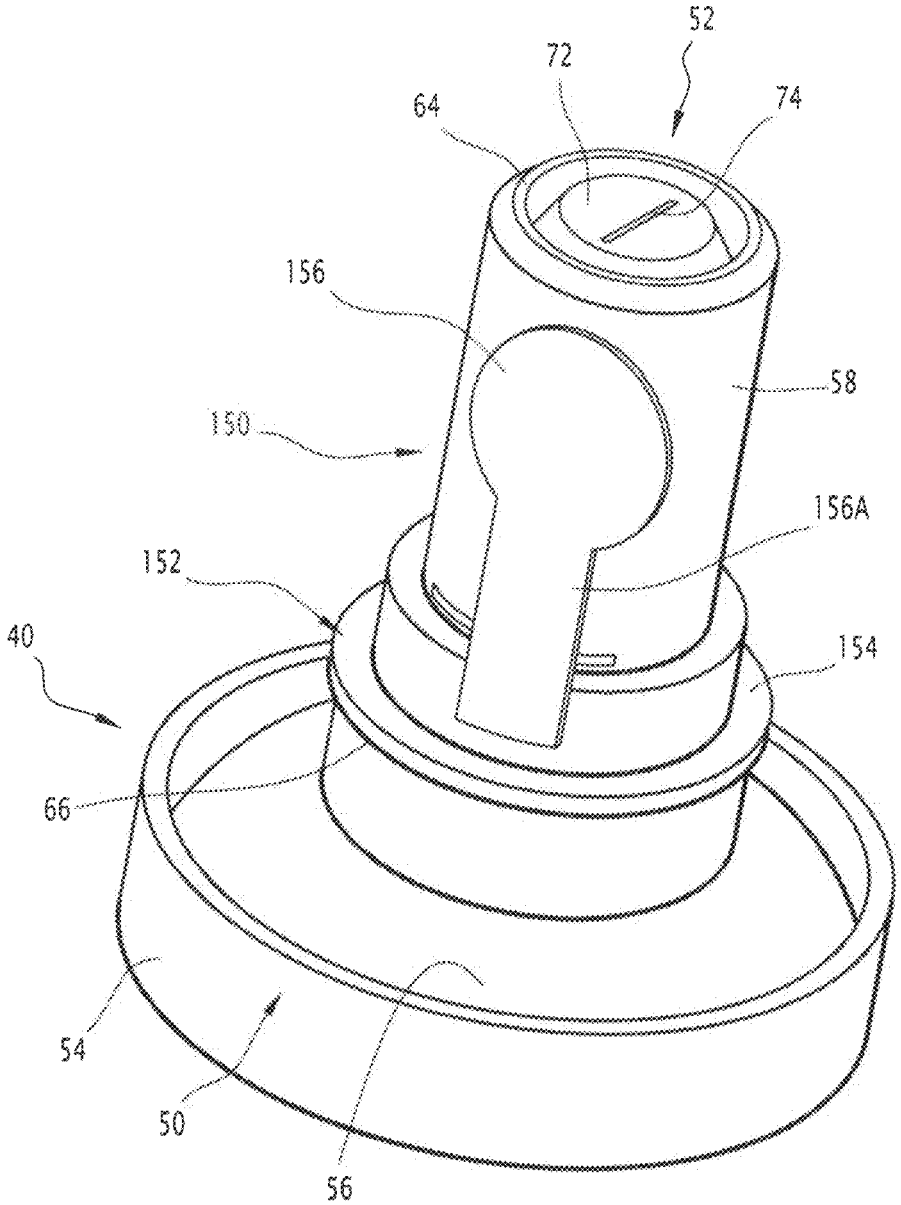
FIG. 19 is a view similar to FIG. 18 after its first use.

As illustrated in FIGS. 18 and 19, the frangible film 156 is in the form of a disk. It is fastened at its periphery to the free edge 64 of the sleeve 58 by a peelable connection such as an adhesive. It is fastened in a more solid manner to the ring 152 by way of a tongue 156A which attaches the periphery of the film 156 to the ring 152. Initially, the tongue 156A forms a fold along the peripheral edge of the film 156 and is pressed under the film 156.

The way in which the second device 130 works differs from the way in which the first device 10 works in that the movement of the container 14 toward the dispenser 16 deforms each resilient tongue 148 in order to guide its free external end 146, which is able to move together with the container 14, under its internal end 144, which is connected to the upper edge 140 of the closure element 82.

Thus, the deformation of the tongues 148 leads to the creation of an annular cavity 158 delimited laterally by the tongues 148 and on the inside by the base wall 112 of the closure element. The abutment 94 is held partially in the annular cavity 158 in the predispensing position shown in FIG. 9.

Moreover, the passage of the end piece 40 from its initial rest position toward its predispensing position causes the retaining ring 152 to move up along the external surface of the sleeve 58 until the ring 152 comes into contact with the external shoulder 66 defined by the sleeve 58. During this movement, the tongue 156A, secured to one end of the ring 152, pulls on the film 156 which progressively detaches from the edge 64 of the sleeve 58, turning back on itself.

Figure 11:
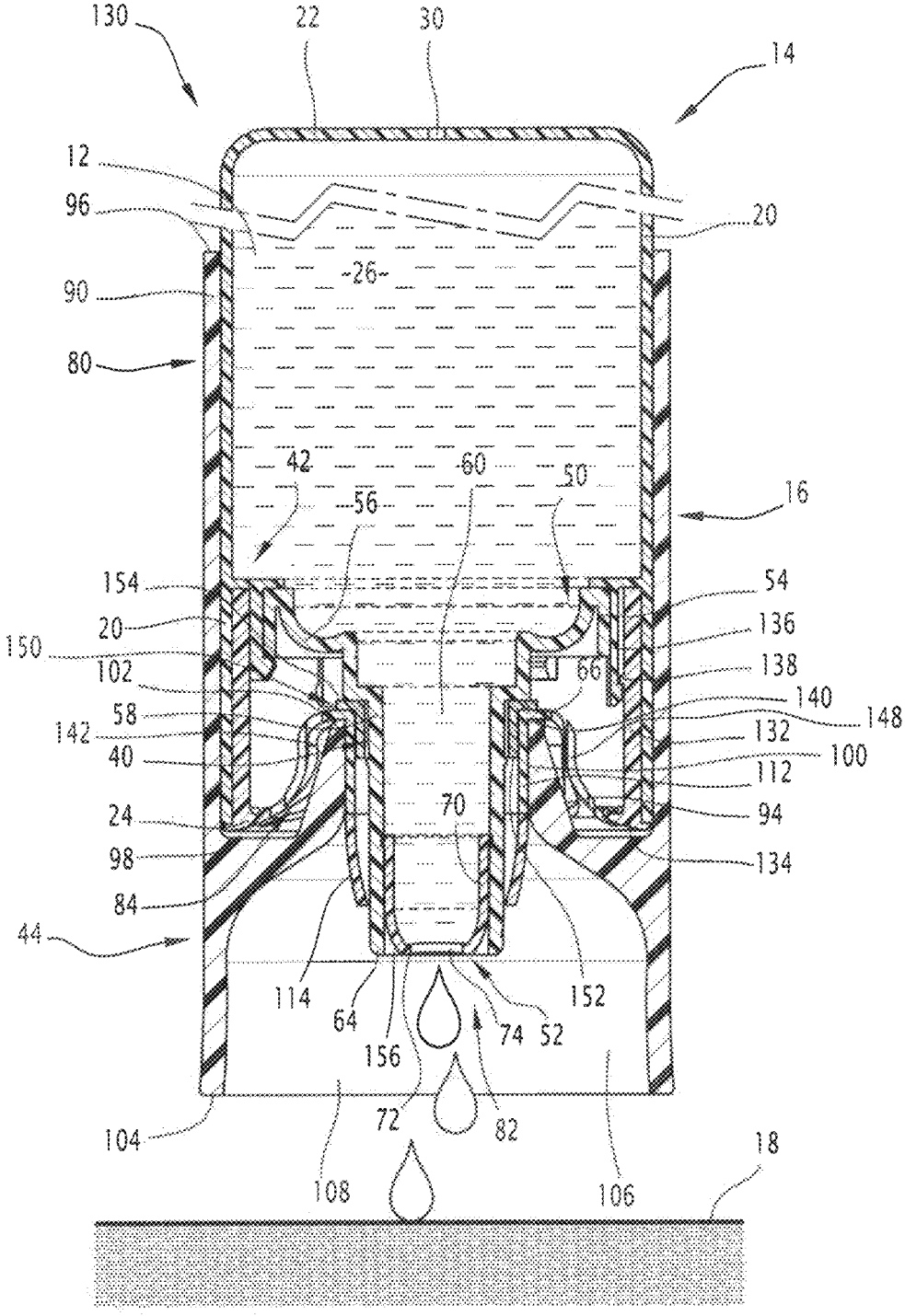
FIG. 11 is a view similar to FIG. 5 of the second device according to the invention.
Figure 12:
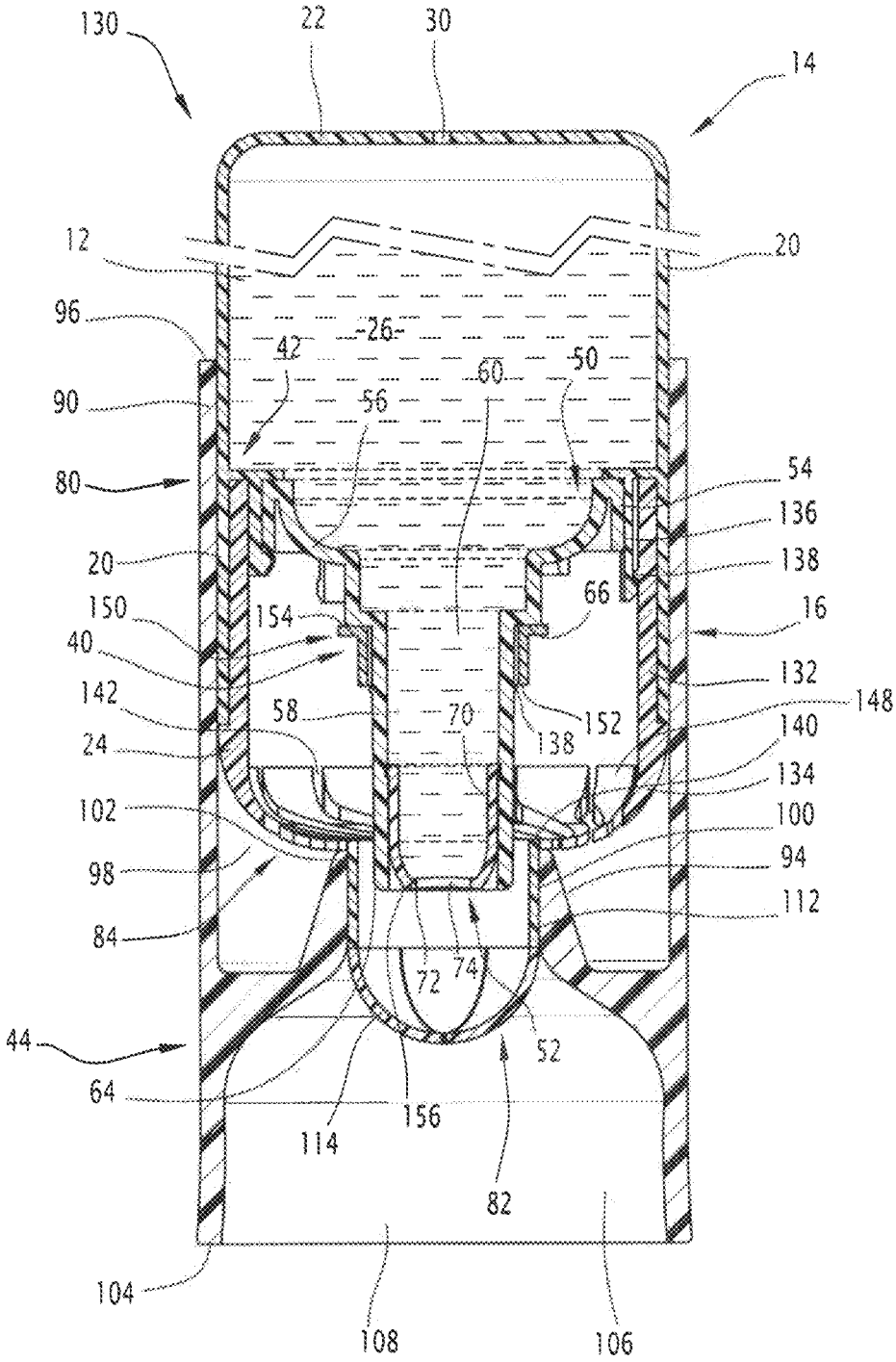
FIG. 12 is a view similar to FIG. 6 of the second device according to the invention.

Next, after the passage of the end piece 40 into its dispensing position shown in FIG. 11, in which the connecting wall 56 deforms, the ring 152 moves up together with the sleeve 58 and remains fastened on the shoulder 66 while the end piece 40 returns upward as far as its rest position under the effect of the connecting wall 56.

Figure 13:
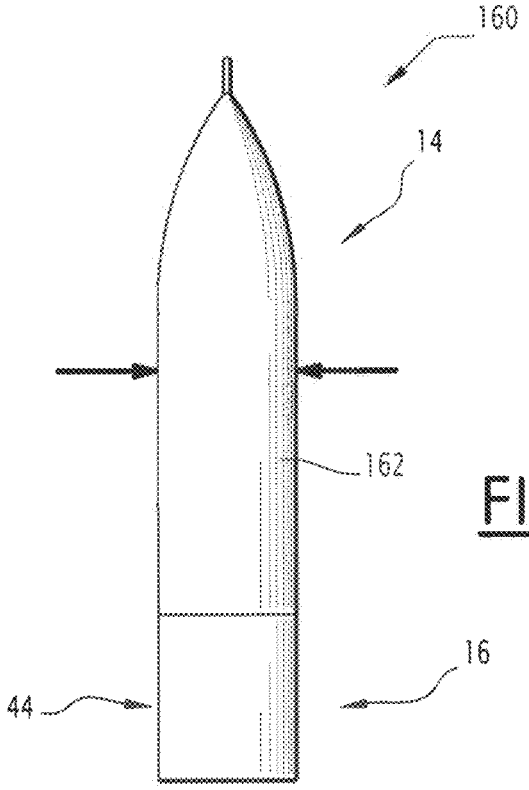
FIG. 13 is a view similar to FIG. 1 of a third device according to the invention.

A third device 160 according to the invention is shown in FIG. 13. Unlike the first device 10, the container 14 is formed by a tube 162 which can be deformed by pinching to create pressure by reducing the internal volume 26.

The tube 162 is fitted in a fixed manner with respect to the dispenser 44. The protective means 44 have no closure element 82 and the end piece 40 is fitted in an immobile manner in the protective means 44.

Figure 14:
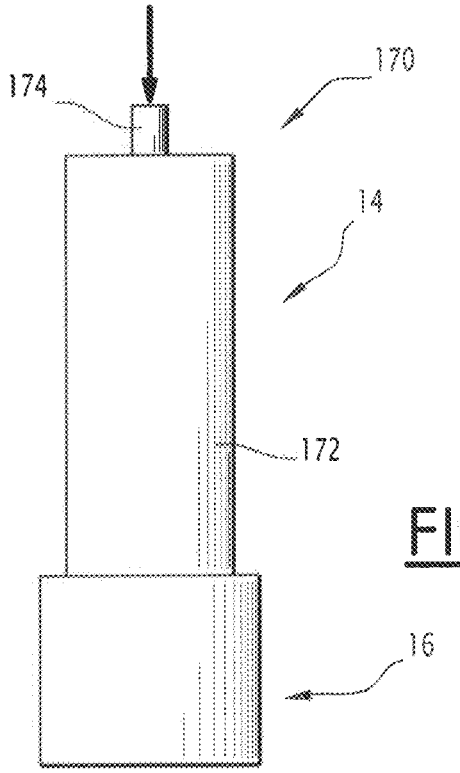
FIG. 14 is a view similar to FIG. 1 of a fourth device according to the invention.

A fourth device 170 according to the invention is shown in FIG. 14. Unlike the first device 10, the container 14 comprises a casing 172 fitted in a fixed manner with respect to the dispenser 16. The casing 172 has a reservoir (not shown) for cosmetic product and an actuating button 174, fitted such that it can move with respect to the casing 172, for dispensing product.

The actuation of the actuating button 174 moves the end piece 40 from its rest position successively toward its predispensing position and toward its dispensing position, and advantageously opens the closure element 82, as described hereinabove. Releasing the button 174 enables the end piece 40 to return to its rest position.

Figure 15:
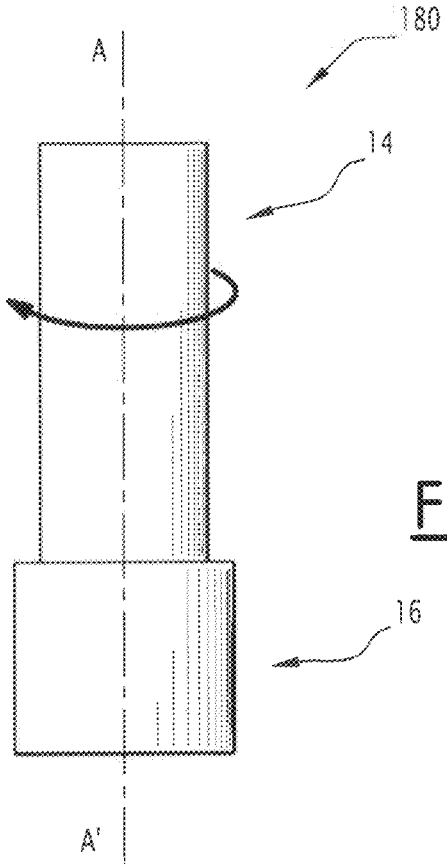
FIG. 15 is a view similar to FIG. 1 of a fifth device according to the invention.

A fifth device 180 according to the invention is shown in FIG. 15. Unlike the first device 10, the container 14 is fitted such that it can rotate with respect to the dispenser 16 in order to dispense cosmetic product 20.

The fifth device 180 has a mechanism (not shown) for converting the rotational movement of the container 14 into a translational movement of the end piece 40 of the container 14. The rotation of the container 14 about its rotational axis successively causes the passage of the end piece 40 from its rest position, into its predispensing position and then into its dispensing position.

Figure 16:
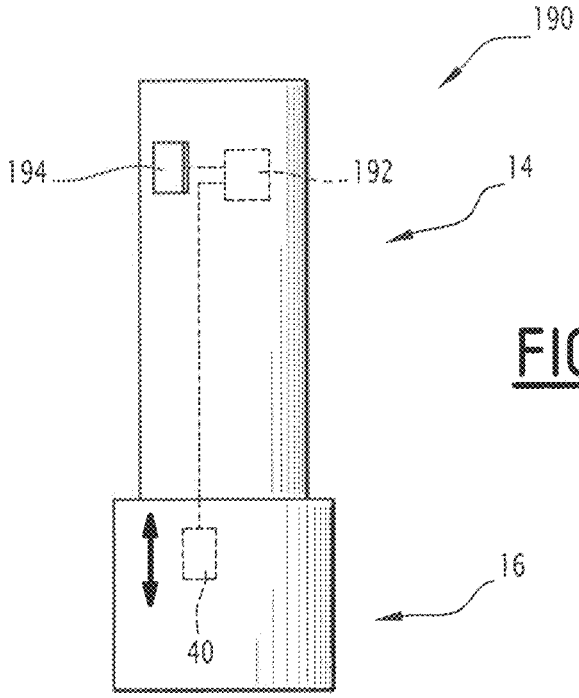
FIG. 16 is a view similar to FIG. 1 of a sixth device according to the invention.

A sixth device 190 according to the invention is shown in FIG. 16.

Unlike the first device 10, this device 190 comprises a motor 192 controlled by an actuating button 194. The motor 192 is connected to the end piece 40 in order to move the end piece 40 in translation between its rest position, its predispensing position and its dispensing position when the actuating button 194 is pressed.

Figure 17:
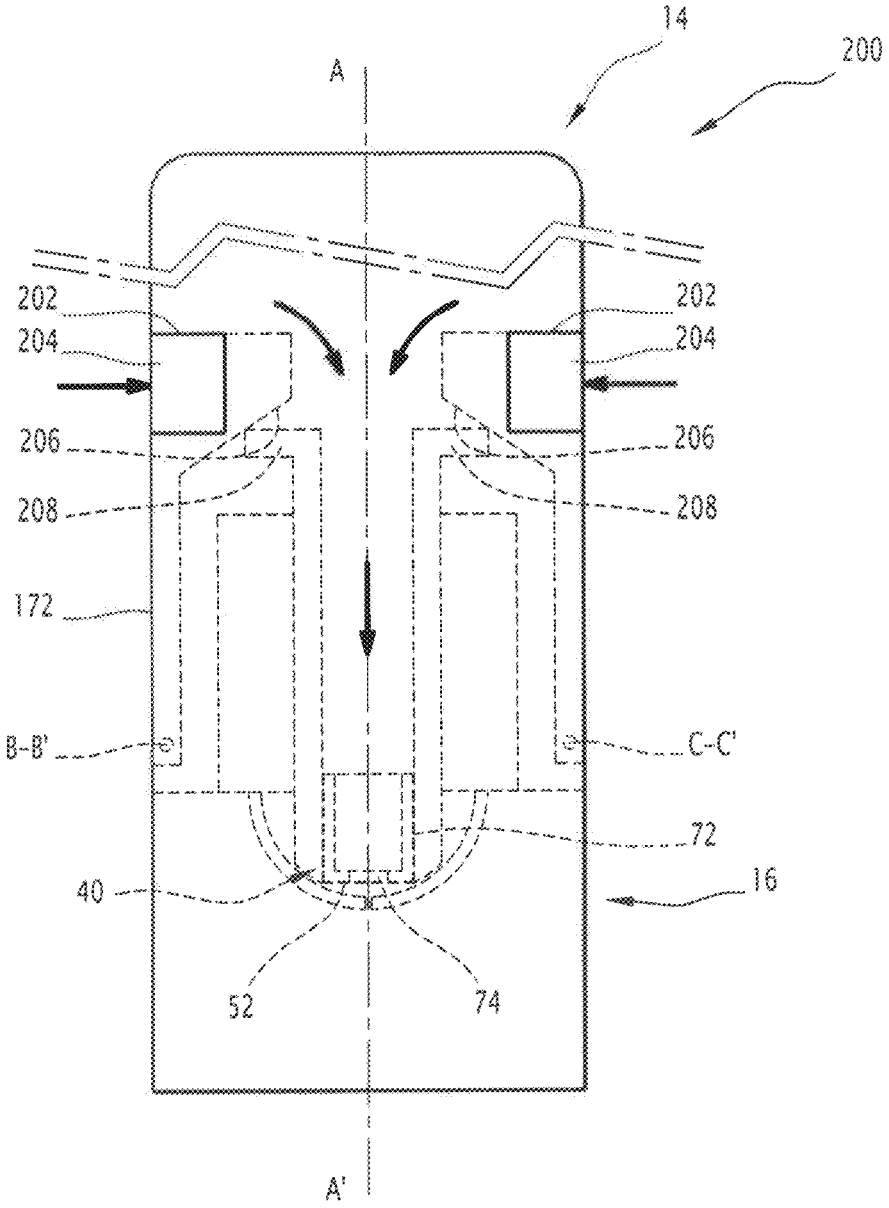
FIG. 17 is a view similar to FIG. 1 of a seventh device according to the invention.

A seventh dispensing device 200 according to the invention is shown in FIG. 17.

As in the fourth device 170, the container 14 comprises a casing 172 which is fixed with respect to the dispenser 16.

The casing 172 has two opposite lateral openings 202 for the access of rotary control lugs 204.

Each lug 204 is fitted such that it can rotate in the casing 172 about a respective axis B-B', C-C' on either side of the axis A-A', perpendicularly to the axis A-A', between an external rest position and an internal depressed position for moving the end piece 40.

Each lug 204 has a beveled lower surface 206 inclined with respect to the axis A-A'. The internal surface 206 is able to engage with a flange 208 secured to the end piece 40 in order to convert the rotary movement of the lugs 204 into a translational movement of the end piece 40 between its rest position, its predispensing position and its dispensing position.

In order to use the seventh device 200, the user pinches the lugs 204 through the lateral openings 202 by moving them toward one another toward the axis A-A'. This moves the end piece 40 in translation along the axis A-A', as described hereinabove.

Alternatively, temperature adjusting means, for example heating and/or cooling means are provided in the dispensing device, for example at the end piece 40 in order to set the viscosity of the cosmetic product dispensed.

In other variants, which are not shown, the closure element 82 is formed by a shutter, a flap, a membrane, a guillotine or a fan.

As a further variant, the container 14 is fitted removably, for example by screwing or snap-fastening into the dispenser 16. Once the cosmetic product in the container 14 has been used up, it is possible to remove the empty container from the dispenser and to fit a replacement container 14 full of product.

A kit for dispensing cosmetic product and comprising a removable container 14, a dispenser 16 as defined hereinabove, advantageously contained in packaging, can also be provided for the user.

The term "one" should be understood as meaning "at least one" unless the contrary is specified.

It can be naturally inferred from the above description and the enclosed figures that the relative orientations of the structural features of the device are those which result from the normal use of the device, in particular in the predispensing position and in the dispensing position. These orientations are meant in particular in reference to a placement of the dispenser 16 below the container 14, while axis A-A' of the container 14 and advantageously of the end piece 40 is maintained approximately vertical, and in reference to a placement of the receiving surface 18 below the end piece 40.

Axis A-A' is in particular perpendicular to the mean plane of the free edge 104 of the skirt 92 and advantageously to the mean plane of the dispensing orifice 74.

Thus, in this configuration, the passage opening 108 is located below the end piece 40 when moving downwardly along axis A-A'. The passage opening 108 is additionally located apart, at a non-zero distance along axis A-A' from the dispensing orifice 74, at least in the predispensing position and in the dispensing position.

The volume located under the end piece 40 is in particular the volume generated along axis A-A' under the dispensing orifice 74.

In the dispensing position, the cosmetic product dispensed through the dispensing orifice 74 is therefore able to flow vertically in a downward direction by gravity from the end piece 40, through the volume located under the end piece 40, so as to reach the receiving surface 18.

In this orientation, the closure element 82 occupies a closed configuration, in which it closes the volume located under the end piece 40, and an open position, in which the volume located under the end piece 40 is free, in particular under the distribution orifice 74.

It can be noted that the passage of the end piece 40 from its free dispensing position towards its dispensing position occurs exclusively when the closure element 82 occupies its open configuration.

As a consequence, the cosmetic product which is dispensed through the end piece 40 in the dispensing position does not come into contact with the closure element 82, which avoids any microbial contamination at the closing member 82.

It can also be inferred that the end piece may be movable, in particular in translation relative to the protective means 44.

As a variant, the end piece 40 may be still, in particular in translation, relative to the protective means 44, the closure element 82 passing from its open configuration to its closed configuration without a movement of the end piece 40.

As it has been seen above, the protective means 44 hinder contact between a body surface of a user of the dispenser 16 and the dispensing orifice 74. This body surface may be the receiving surface on which the cosmetic product is intended to be applied, or another body surface which can accidentally or voluntarily contact the device, in particular in the case in which the receiving surface 18 is delimited in a receptacle.

Obviously, numerous modifications and variations of the present invention are possible in light of the above teachings. It is therefore to be understood that within the scope of the appended claims, the invention my be practiced otherwise than as specifically described therein.

What is claimed:

1. A dispenser for dispensing cosmetic product onto a receiving surface, comprising:

an end piece defining a product dispensing orifice configured to be opened opposite a receiving surface located under the end piece;

protective means for protecting the dispensing orifice so as to hinder contact between a body surface of a user of the dispenser and the dispensing orifice, the protective means protruding downward beyond the end piece and delimiting an opening, for the passage of the cosmetic product, wherein the protective means includes a closure element, configured to be maneuvered between a closed configuration closing off the volume located under the end piece opposite the dispensing orifice and an open configuration freeing the volume located under the end piece, wherein the protective means defines a protective cavity opening downwardly outside of the dispenser through a passage opening, and wherein the protective means includes a base holding the end piece, the closure element being fitted permanently on the base and being able to be maneuvered between the closed configuration closing off the volume located under the end piece opposite the dispensing orifice and an open passage configuration of the end piece, wherein the end piece is configured to be maneuvered in the open configuration of the closure element between a predispensing position, in which the dispensing orifice is closed off and is in a rest position when the dispensing orifice is closed off, and a dispensing position, in which the dispensing orifice is open so that product can flow by gravity through the dispensing orifice and onto the receiving surface, wherein said receiving surface can be moved independently of the protective means, wherein the passage opening is located opposite and underneath the dispensing orifice in the predispensing position and in the dispensing position, and wherein a cross section of the passage opening is greater than a cross section of the dispensing orifice.

2. The dispenser as claimed in claim 1, wherein the protective means includes a protective peripheral skirt arranged around the end piece, the peripheral skirt delimiting the passage opening.

3. The dispenser as claimed in claim 1, wherein a minimum distance between the dispensing orifice and the passage opening in the dispensing position is greater than or equal to 0.4 times a maximum transverse extent of the passage opening.

4. The dispenser as claimed in claim 1, wherein the passage opening is located underneath and spaced apart from the closure element in the predispensing position and in the dispensing position.

5. The dispenser as claimed in claim 1, wherein the end piece is configured to be moved with respect to the protective means between a rest position and the predispensing position, the movement of the end piece between the rest position and the predispensing position causing the closure element to pass from the closure element's closed configuration into the closure element's open configuration.

6. The dispenser as claimed in claim 5, wherein the protective means includes a member urging the end piece into the end piece's rest position, the urging member provided integrally with the closure element.

7. The dispenser as claimed in claim 5, wherein the end piece is configured to move with respect to the protective means between an initial rest position and the predispensing position, the protective means including a frangible seal which can be broken when the end piece is moved for the first time with respect to the protective means between the rest position and the predispensing position.

8. The dispenser as claimed in claim 1, further comprising actuating means for actuating the dispensing of cosmetic product onto the receiving surface, the actuating means configured to be activated outside the protective means in order to move the end piece from the end piece's predispensing position into the end piece's dispensing position.

9. The dispenser as claimed in claim 8, wherein the actuating means can be activated by the user in order successively to move the closure element from the closure element's closed position into the closure element's open position, and then to move the end piece from its predispensing position into its dispensing position.

10. The dispenser as claimed in claim 8, wherein the end piece has a region that can be deformed under an effect of activation of the actuating means, passage of the end piece from the end piece's predispensing position into the end piece's dispensing position being brought about by the deformable region being deformed.

11. A device for dispensing cosmetic product, comprising:

a dispenser as claimed in claim 1; and a cosmetic product container, the dispenser being fitted at a lower end of the container.

12. The device as claimed in claim 11, wherein the container is vertically elongated along a container axis, the dispensing opening in the container axis.

13. A method for dispensing a cosmetic product onto a receiving surface, the method comprising:

supplying a device as claimed in claim 11;

placing the device opposite and above the receiving surface; moving the closure element from the closure element's closed configuration to its open configuration;

putting the end piece into its predispensing position, in which the dispensing orifice is closed off and the volume located under the dispensing orifice through the passage opening, opposite the receiving surface, is entirely free, the protective means protruding below the end piece in order to hinder contact between a body surface of the user of the device and the dispensing orifice;

maneuvering the end piece in order to move the end piece from the end piece's predispensing position into the end piece's dispensing position, the closure element; and flowing the cosmetic product by gravity from the dispensing orifice, through the protective means and the passage opening, onto the receiving surface.

14. The dispenser as claimed in claim 1, wherein the protection means comprises a rigid skirt, the end piece being movable between the rest position and the predispensing position without deforming the skirt.

15. The dispenser as claimed in claim 1, wherein the passage opening is configured so that the cosmetic product can fall by gravity through the protective means to the receiving surface without contacting an intermediate element connected to the protective means.

16. A dispenser for dispensing cosmetic product onto a receiving surface, comprising:

an end piece defining a product dispensing orifice configured to be opened opposite a receiving surface located under the end piece and wherein said receiving surface can be moved independently of the protective means;

protective means for protecting the dispensing orifice so as to hinder contact between a body surface of a user of the dispenser and the dispensing orifice, the protective means protruding downward beyond the end piece and delimiting an opening, for the passage of the cosmetic product, wherein the protective means includes a closure element, configured to be maneuvered between a closed configuration closing off the volume located under the end piece opposite the dispensing orifice and an open configuration freeing the volume located under the end piece, wherein the protective means defines a protective cavity opening downwardly outside of the dispenser through the passage opening, wherein the end piece is configured to be maneuvered in the open configuration of the closure element between a predispensing position, in which the dispensing orifice is closed off and is in a rest position when the dispensing orifice is closed off, and a dispensing position, in which the dispensing orifice is open so that product can flow by gravity through the dispensing orifice and onto the receiving surface, and wherein the end piece is configured to be moved with respect to the protective means between a rest position and the predispensing position, the movement of the end piece between the rest position and the predispensing position causing the closure element to pass from the closure element's closed configuration into the closure element's open configuration, wherein the passage opening is located opposite and underneath the dispensing orifice in the predispensing position and in the dispensing position, and wherein a cross section of the passage opening is greater than a cross section of the dispensing orifice.

* * * * *